United States Patent [19]

Morstain et al.

[11] Patent Number: 4,496,148

[45] Date of Patent: Jan. 29, 1985

[54] SPORTING EVENT ANALYSIS DEVICE

[75] Inventors: Barry R. Morstain, 28 E. Cleveland Ave., Newark, Del. 19711; Melvin F. Danner, Frederick, Md.

[73] Assignee: Barry R. Morstain, Newark, Del.

[21] Appl. No.: 329,140

[22] Filed: Dec. 9, 1981

[51] Int. Cl.[3] ..... A63B 71/04; A63F 7/00

[52] U.S. Cl. ..... 273/1 E; 273/85 G; 273/94

[58] Field of Search ..... 273/DIG. 28, 88, 94, 273/1 E, 1 GC, 85 G

[56] References Cited

U.S. PATENT DOCUMENTS

| | | | |
|---|---|---|---|
| 3,718,812 | 2/1973 | Tillman et al. | 273/54 C |
| 3,860,239 | 1/1975 | Feuer et al. | 273/88 |
| 4,030,764 | 6/1977 | Mattos | 273/148 A |
| 4,093,223 | 6/1978 | Wilke et al. | 273/94 R |
| 4,141,548 | 2/1979 | Everton | 273/1 E |
| 4,162,792 | 7/1979 | Chang et al. | 273/85 G |
| 4,169,262 | 9/1979 | Schwartz et al. | 273/DIG. 28 |
| 4,193,600 | 3/1980 | Armstrong et al. | 273/148 R |
| 4,195,838 | 4/1980 | Santandrea et al. | 273/88 |
| 4,220,992 | 9/1980 | Blood et al. | 364/410 |
| 4,240,632 | 12/1980 | Watanabe | 273/88 |
| 4,240,633 | 12/1980 | Watanabe | 273/88 |
| 4,249,734 | 2/1981 | Bromley | 273/94 |
| 4,249,735 | 2/1981 | Bromley | 273/94 |
| 4,249,744 | 2/1981 | Bromley | 273/85 G |
| 4,304,404 | 12/1981 | Pundt | 273/85 G |
| 4,359,222 | 11/1982 | Smith et al. | 273/85 G |

*Primary Examiner*—Richard C. Pinkham
*Assistant Examiner*—MaryAnn Stoll
*Attorney, Agent, or Firm*—Fleit, Jacobson, Cohn & Price

[57] ABSTRACT

A sports analysis device for use by at least one user in conjunction with observation of an actual sporting event comprises a keyboard for selecting a responsive play strategy deemed by the user(s) to be a play strategy appropriate for implementation at a given point in the actual sporting event, and for entering into the device data indicating the actual play and results occurring in the sporting event. A memory memorizes the play strategies and/or results, while a processor processes-/analyzes the selected strategies in accordance with the actual play results so as to evaluate the effectiveness of each user in selecting a respective play strategy. A display displays feedback messages apprising each user of the evaluated effectiveness. Other features of the device include the ability to select a given degree of performance with respect to which the effectiveness of each user is evaluated, the ability to select one of a plurality of configurations, the ability to select the number of users to use the device, and the ability to select a desired array of available strategies from which to choose when selecting respective play strategies. The device is preferably equipped with a keypad scanner which is removable and interchangeable so as to convert the device from one type of sporting event to another.

19 Claims, 7 Drawing Figures

SPORTING EVENT ANALYSIS DEVICE

BACKGROUND OF THE INVENTION

1. Field of the Invention

The present invention relates to a sporting event analysis device, and more particularly to an electronic device which permits one or more users to determine and analyze the nature and effectiveness of one's play strategies compared to those of the coach or manager of an actual team engaged in a sports athletic contest.

2. Description of the Prior Art

Keen interest in sports plus the advent and commercialization of integrated circuit chips has resulted in the development of electronic games and devices related to various sports. By far, the largest category of devices are electronic games developed for the purpose of amusement, while a few devices are geared to the scoring and/or analysis of individual player performance.

In the largest category of electronic games, those for amusement, players match their skills against each other (or against the computer) while "simulating" the play of baseball, football, basketball, hockey, etc. Typical of these simulated athletic contest devices are those disclosed by the following U.S. Pat. Nos. 3,860,239; 4,240,632; 4,240,633; and 4,195,838 (each of the latter pertaining to baseball); and 4,162,792; 4,249,734; and 4,249,735 (each of the latter pertaining to football). Further illustration of these developments is found in U.S. Pat. No. 4,249,744, which describes a generic method appropriate to a variety of electronically simulated sports action contests.

Each of the devices of the aforementioned patents is based on a similar framework and mode of operation—the simulation of an athletic contest with simulated players and/or teams. Simulation of plays and events is accomplished by a visual display of lights or figures which represent "players" or "teams". In many (if not all) instances, the performance of a particular simulated "player" or "team" results in large part, if not exclusively, from the device user's dexterity and coordination (such as manual or wrist dexterity and ocular coordination) which affect the outcome of the simulated contest in a positive or negative manner.

In the aforementioned disclosures, there is no operational reference to real players or teams engaged in an ongoing actual contest. That is to say, a user's score in the game device is principally determined by eye-hand coordination in the electronically simulated athletic contest.

Other electronic devices have been developed to assist in the scoring and/or analysis of card games or sport events. Illustrative of these devices are the following U.S. Pat. Nos. 4,030,764 (a bridge-bidding indicator); 4,193,600 (a cribbage scoring device); and 3,718,812 (a bowling score computer). U.S. Pat. No. 4,141,548 provides a device which allows a user to enter beforehand a prediction of a play and yardage outcome for a football team engaged in an actual game. The device, however, is structured only for the sport of football, is AC-powered and non-portable, and is geared to a limited set of four play predictions (i.e., run, pass, punt, field goal) in which one's score is premised solely on comparing what was predicted to what occurred (via "an "immediate play" electronic signal comparison). User feedback from this comparison is only a numeric, overall score and is not separable or distinguishable by team. Since there is no micro-computer providing a memory capability, no data are stored to provide various measures of play effectiveness or to give "feedback" analyses in a user-choice mode with respect to different plays.

U.S. Pat. No. 4,220,992, while being portable and having memory capability, is geared to an "individual player" sport, and, in this particular case, is intended to provide recording and assessment of golf shots made by a single player. The device is not intended for comparisons of the shots made by two individual golfers, nor is it intended for "team sports" in terms of their respective plays and the effectiveness of same. Thus, the latter patent is geared to having a single user of the device (such as a recruiter or scout) and is used for monitoring an individual player's performance, not for one or two users who wish to record and assess the nature, effectiveness and outcomes of play strategies for team sports, such as football or baseball.

To summarize, the prior art, as exemplified by the aforementioned patents, is directed toward the following: (1) amusement devices in which the "simulation" of an athletic contest is featured, and involving lights/representational figures where eye-hand coordination is central to the outcome of the games; and (2) data devices in which one predicts a play in a team sport, or in which one records data for an individual sport such as golf (e.g., U.S. Pat. No. 4,220,992 above), and which devices are directed to the individual performance of a single player/golfer. Moreover, the prior art in this latter domain has not disclosed a singular device which is readily adaptable to a variety of sports, or a device which permits user-chosen recall/analysis from computer memory of team play strategies and the effectiveness of same.

SUMMARY OF THE INVENTION

The present invention relates to a sporting event analysis device, and more specifically to an electronic device which permits one or more users of the device to determine and analyze the nature and effectiveness of one's play strategies, as compared to those of the coach or manager of an actual team engaged in an ongoing athletic contest.

Basically, the electronic device presently disclosed comprises a portable, battery-powered, microcomputer-controlled device which permits the user to both record and assess his own play strategies for a variety of team sports, the device being selectively dedicated to a particular team sport at a given time.

Accordingly, the device of the present invention comprises a portable, battery-powered, self-contained device which, under microcomputer control, can perform a given sport, but which can be adapted by the user to implement a different sport by merely substituting a corresponding different "sport keypad", having its own unique game control instructions stored in a read-only memory associated therewith. When the device is equipped with a particular "sport keypad" selected by the user, a base system of the device operationally combines with the "sport keypad" (the latter including various operational elements such as a read-only memory, program memory, keypad scanner, etc.) to implement the particular sport corresponding to the keypad selected by the user.

In addition, the device of the present invention is truly "interactive" with the user, in that it employs a plurality of words and phrases which are presented on a user display, thus providing alphanumeric feedback and evaluation to the user at selected and appropriate instances during the operation of the device.

Basically, the device of the present invention comprises an interchangeable keypad (including associated keypad scanner, character generator, read-only memory (ROM), program memory, power on/reset circuit, and oscillator circuit), as well as a microprocessor unit, a function selector, a character decoder circuit, a character select circuit, various latch circuits, and an appropriate display section. Preferably, the display section provided with the device of the present invention includes two rows of sixteen-character, fourteen-segment displays, the top row being for display of the score of the particular contest and indicating the team on offense (for football) or at bat (for baseball) whose strategies are being assessed. The bottom row also has a sixteen-character, fourteen-segment display for displaying various alphanumeric messages, promptings, and comments, and is used to provide the user with "feedback" relating to the particular plays, and to the game or contest in general.

Therefore, it is a primary object of the present invention to provide a sporting event analysis device, and more particularly an electronic device which permits one or more users to determine and analyze the nature and effectiveness of one's play strategies compared to those of the coach or manager of an actual team engaged in an ongoing athletic contest.

It is an additional object of the present invention to provide a portable, battery-powered, microcomputer-controlled device which permits one or more users to both record and assess one's own play strategies for a variety of team sports (such as football and baseball).

It is an additional object of the present invention to provide a device which allows for a plurality of evaluations of one's own play strategies, as compared (on a selective basis) to those of the "real" coach or manager of a team actually engaged in an ongoing athletic contest, or to those of a second, concomitant user of the device.

It is an additional object of the present invention to provide a device which reflects a realistic and varied array of play strategies which occur in team sport athletic contests, and an array which allows for a choice of strategies and the assessment of the same.

It is an additional object of the present invention to provide a device which can record and store data (in computer memory), according to the nature of each type of play and outcome, and which permits for a plurality of analyses and performance evaluations for each team on both an overall and a "distinct play" basis.

It is an additional object of the present invention to provide an electronic device which can be readily adapted, by the user, for use in different sports or contests, the device employing a base system in combination with an interchangeable keypad (including a keypad scanner, ROM, etc.), so that the device may be readily adapted by the user for use with a particular one of a plurality of sports.

It is an additional object of the present invention to provide a device which is truly "interactive" with the user, the device employing a plurality of word and phrase displays providing alphanumeric feedback and evaluation at user-determined instances during the operation of the device, this being in addition to numeric display of the score in the particular contest.

The above and other objects that will hereinafter appear, and the nature of the invention, will be more clearly understood by reference to the following description, the appended claims, and the accompanying drawings.

DETAILED DESCRIPTION

The invention of the application will now be more fully described with reference to FIG. 1, which is a general diagram of the portable device of the present invention as configured for football.

Figure 1:
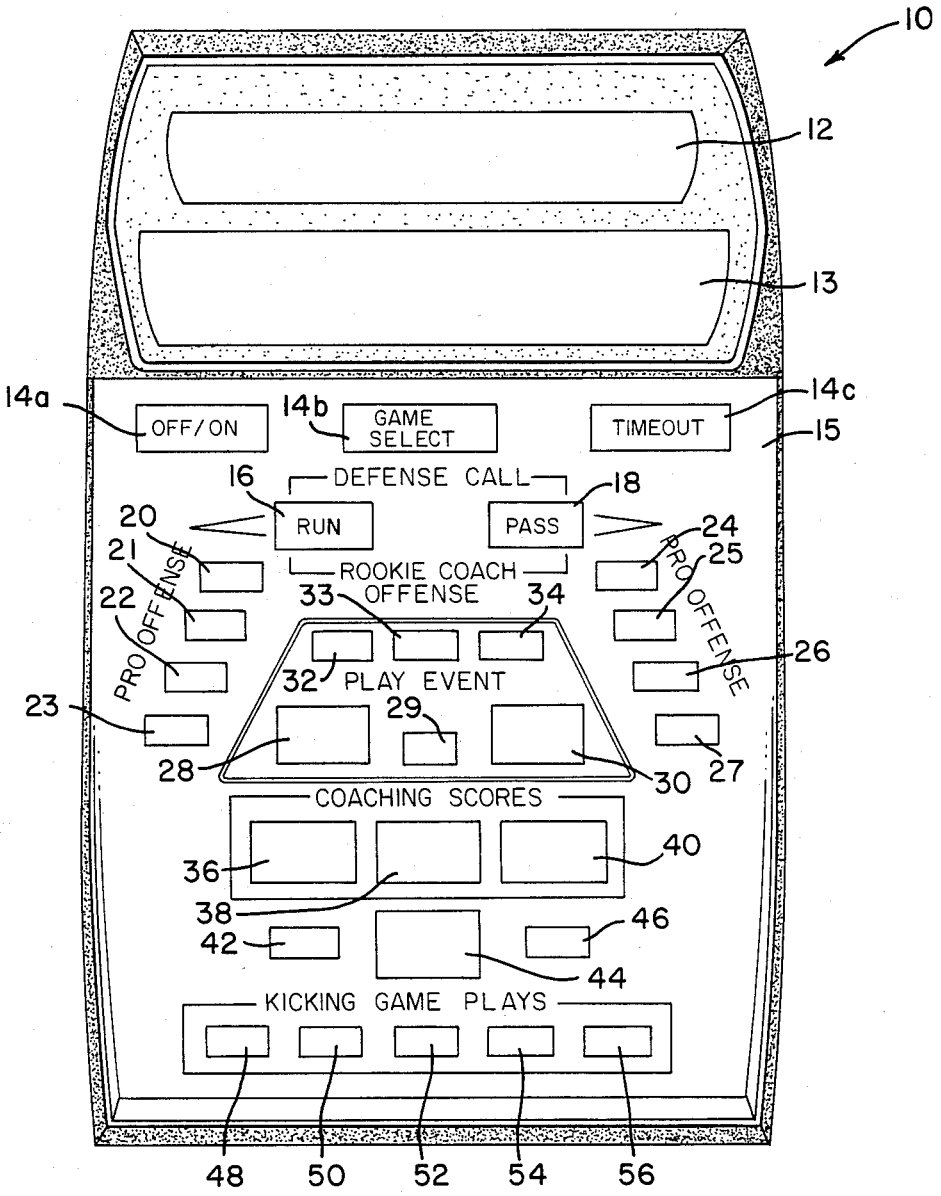
FIG. 1 is a general view of the portable electronic device of the present invention.

As seen in FIG. 1, the device 10 basically comprises a portable, hand-held device including a score and team on-offense display section 12, alphanumeric display section 13, and various control keys on an interchangeable keypad, including the following (as pertains to football): off/on key 14*a*, game select key 14*b*, time-out key 14*c*, run key 16, pass key 18, pro offense keys 20–27, play event keys 28, 29, 30, 32, 33 and 34, coaching score keys 36, 38 and 40, result keys 42 and 46, clear key 44, and kicking game play keys 48, 50, 52, 54 and 56.

It is to be understood that the various control keys are mounted on a keypad 15, along with (as will be seen below) various electronic elements pertaining to the particular game to be played. Thus, the portable device 10 comprises a basic unit, including the displays 12 and 13, as well as various other elements (such as the microprocessor, and other elements to be discussed below), while the keypad 15 comprises a particular keypad selected by the user in accordance with the particular sport that the user desires to play. The keypad 15 shown in FIG. 1 is, of course, intended for use with football, but it is to be understood that a further keypad, containing control keys and various other programmed components relating to any one of a plurality of other sports, can be (in accordance with the invention) selected by the user and mounted on the basic unit so as to adapt the unit for playing of the particular sport selected.

Figure 2:
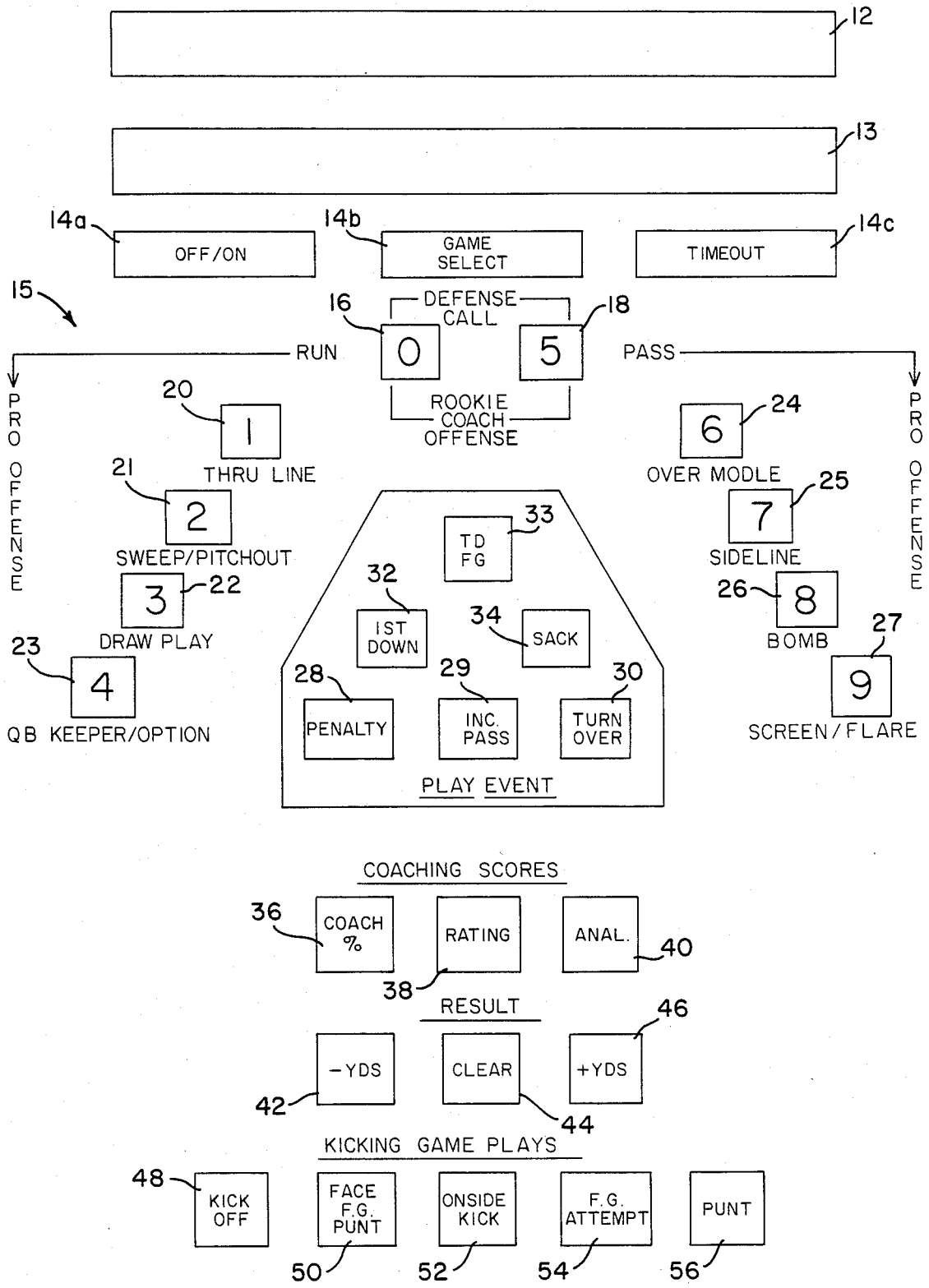
FIG. 2 is a schematic representation of the layout of the keypad of the device of FIG. 1 shown with two display units.

FIG. 2 is a more detailed diagram of the layout of the keypad 15. Since the keypad 15 of FIG. 2 corresponds to those controls necessary for use with a football game, the various controls of FIG. 2 correspond to those shown in FIG. 1, with identical reference numerals being employed therein.

The operation of these controls will be discussed in detail below, in conjunction with a discussion of the operation of the various other elements of the device.

Figure 3:
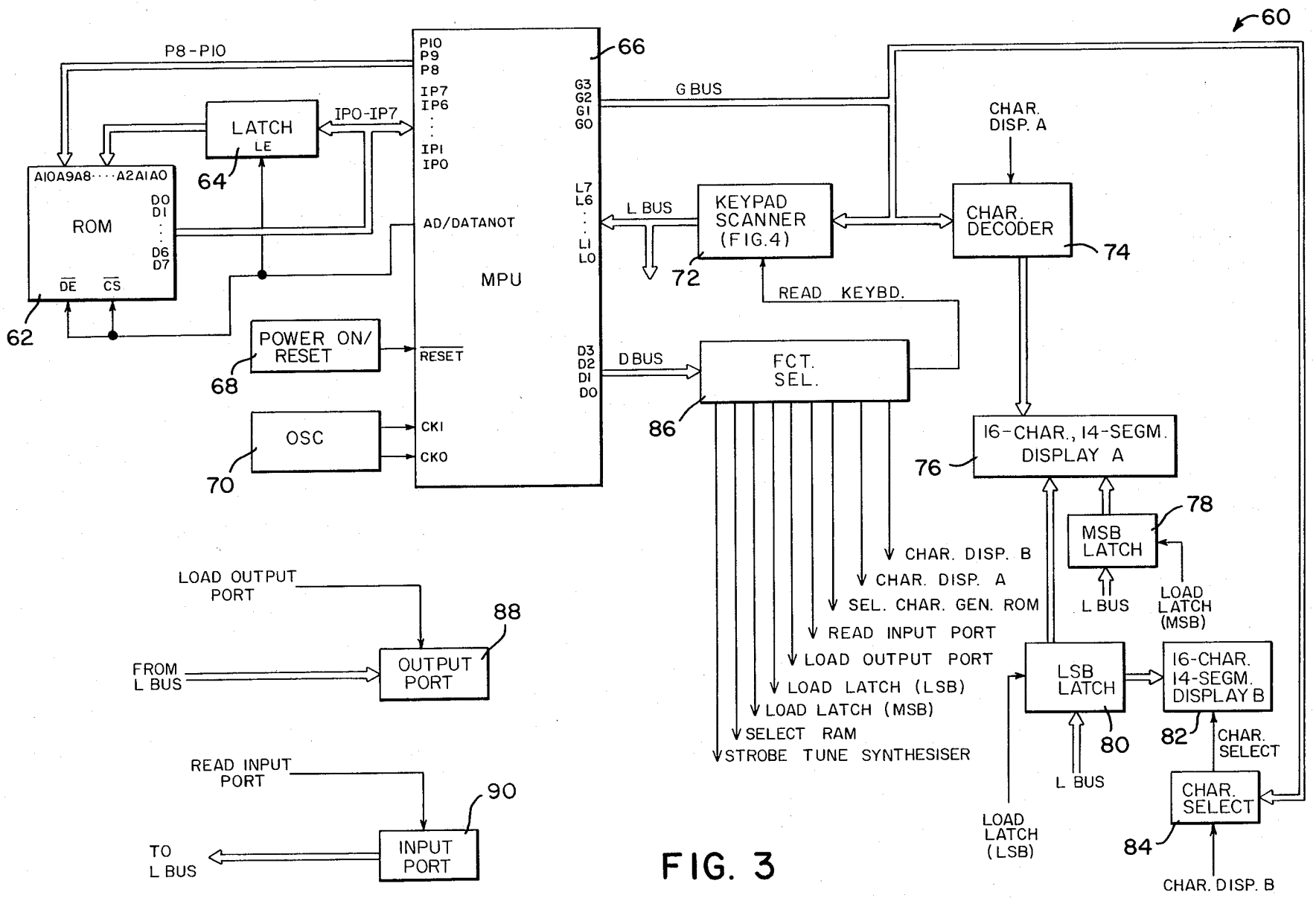
FIG. 3 is a block diagram of the operational system of the device of FIG. 1.

FIG. 3 is a block diagram of the operational system of the device of the present invention. As seen therein, the operational system 60 comprises a read-only memory (ROM) 62, a latch 64, microprocessor unit 66, power on/reset circuit 68, oscillator 70, keypad scanner 72, character decoder 74, sixteen-character, fourteen-segment display 76, most significant bit (MSB) latch 78, least significant bit (LSB) latch 80, sixteen-character, fourteen-segment display 82, character select circuit 84, function select circuit 86, output port 88, and input port 90.

ROM 62 comprises a conventional read-only memory which stores and provides instructions for the operation of the microprocessor unit 66. The ROM 62 is addressed via its address inputs A0–A10, the most significant bits A8–A10 being addressed directly from the microprocessor unit 66 (via terminals P8–P10), the lower bits of the address being provided by latch 64. The address data appearing at the outputs P8–P10 of microprocessor unit 66 is latched by the rising transition of control signal AD/DATANOT (provided by the microprocessor unit 66). Data contained at the specified location in ROM 62 is read into the microprocessor 66 while AD/DATANOT is low, and address data for the ROM 62 is written to the latch 64 when AD/DATANOT is high. Thus, the ROM 62 emulates an on-chip programmable memory of the microprocessor 66.

The microprocessor 66 is a conventional microprocessor, such as the COPS 444L, and operates, under control of the program stored in ROM 62, to control the various operations and flow of data within the overall system 60. Microprocessor 66 receives operator input data via the LBUS from keypad scanner 72, and provides control data to the function selector 86 via DBUS (terminals D0–D3). Microprocessor 66 also provides various control outputs and character display control signals via the GBUS (terminals G0–G3).

Power on/reset circuit 66 provides a low reset signal to the microprocessor 66 on "power up" of the system, while oscillator 70 provides timing for all system events, such timing signals being provided to the clock inputs CK0 and CK1 of microprocessor 66.

Keypad scanner 72, in a manner to be described in more detail below with reference to FIG. 4, detects control inputs from the operator, and provides corresponding control signals via LBUS to the terminals L0–L7 of microprocessor 66. Keypad scanner 72 also receives a READ KEYBD input signal from function selector 86, in response to which the scanner 72 scans the keypad for any operator inputs. Finally, keypad scanner 72 receives a row select input from the microprocessor 66 via GBUS, in response to which a particular row of the keypad is scanned, as will be discussed in more detail below.

Character decoder 74 decodes encoded character position information received via GBUS from the microprocessor 66, and issues corresponding character position signals to the sixteen-character, fourteen-segment display (A) 76, thus indicating to the display 76 the particular character position for which character data is being provided to the display 76.

Display 76 receives the upper byte of character data from MSB latch 78 and the lower byte of character data from LSB latch 80, the MSB latch 78 and LSB latch 80 receiving the character data from the microprocessor 66 via LBUS under the control of control signals LOAD LATCH (MSB) and LOAD LATCH (LSB), respectively, provided by the function selector 86 in response to the input received from microprocessor 66 over DBUS.

The sixteen-character, fourteen-segment display 82 receives a character selection input CHAR SELECT from the character select circuit 84, the latter being enabled by CHAR DISP B from function selector 86 to provide the selection input to display 82 in response to character control data received via GBUS from microprocessor 66. The data displayed by display 82, in accordance with the input CHAR SELECT, is received via LBUS and LSB latch 80 from the microprocessor 66.

As indicated above, function selector 86 responds to control data, provided on DBUS by microprocessor 66, to generate one of ten different control signals.

The system 60 is provided with an output port 88 which, as enabled by the LOAD OUTPUT PORT signal from the function selector 86, takes data from the LBUS and provides it to any external device connected to the output port 88. Similarly, input port 90, as enabled by READ INPUT PORT from function selector 86, receives data from an external device connected thereto, and provides that data to the LBUS. As previously indicated, data read from or provided to LBUS is read from or provided to, respectively, the microprocessor 66. By employing output port 88 and input port 90, the system 60 provides the capability of connecting the device 10 (FIG. 1) to an external unit, such as a console or central control unit, so that the latter can be employed (for example) to control operation of, provide data to, and receive data from a plurality of similar electronic devices.

Figure 4:
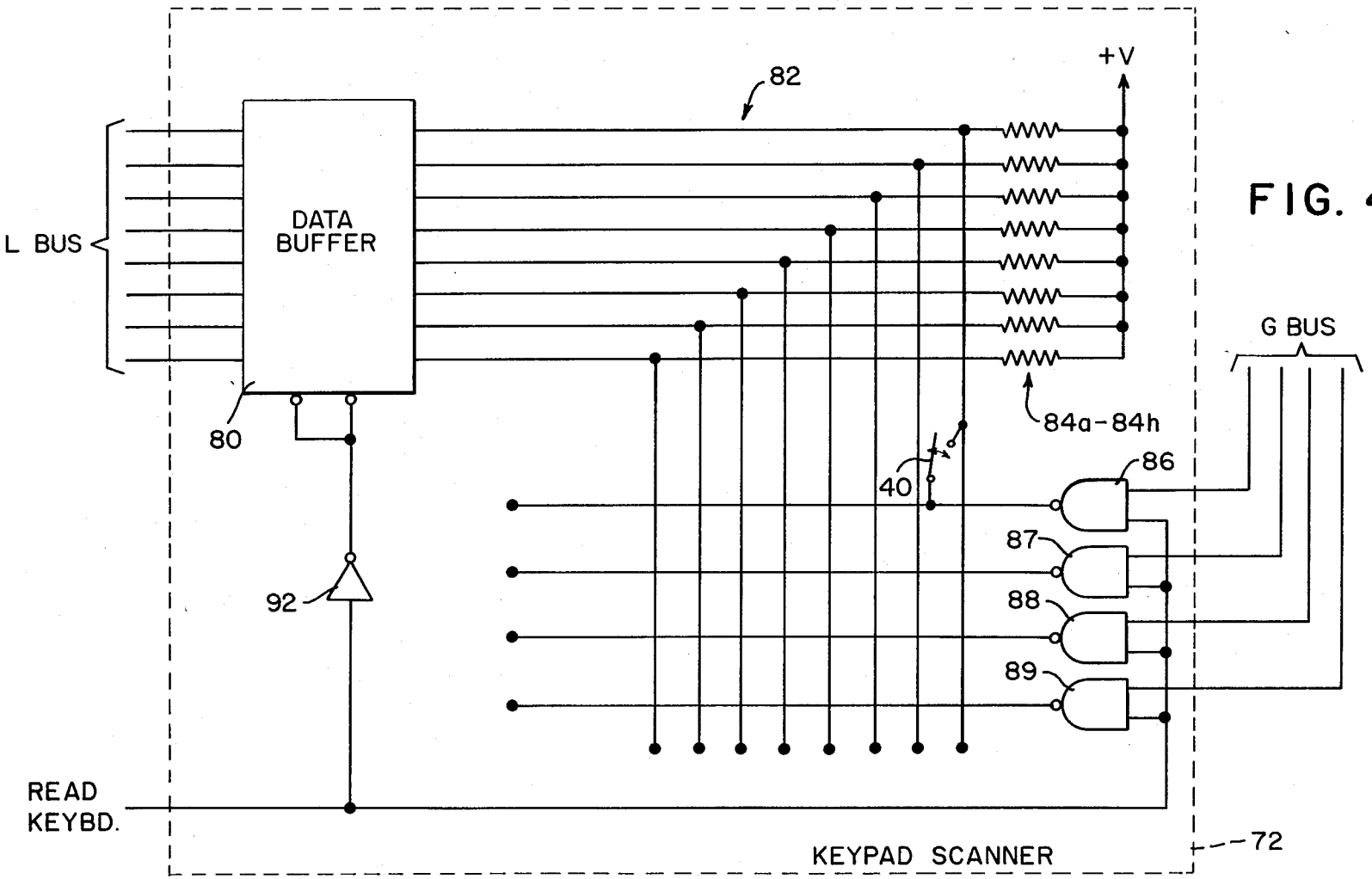
FIG. 4 is a detailed diagram of the keypad scanner of FIG. 3.

FIG. 4 is a detailed diagram of the keypad scanner 72 of FIG. 3. As seen therein, the keypad scanner 72 comprises data buffer 80, row-and-column network 82, pull-up resistors **84*a*–88*h*, NAND gates 86–89, various row-to-column switches, such as switch 90, and inverter 92**.

In operation, a row selection input is received via GBUS from the microprocessor 66. Specifically, microprocessor 66, acting via GBUS, provides a high input to one input of a selected one of the NAND gates 86–89. Function selector 86 (FIG. 3) issues a high output on line READ KEYBD (connected to the other input of each NAND gates 86–89) when a scan of the keypad by keypad scanner 72 is desired. This results in a low output from the selected one of the NAND gates 86. So long as none of the keypad scanner control switches (a typical one is represented by switch 90 in FIG. 4) is actuated, the +V supply voltage applied to resistors **84*a*–84*h* results in all high inputs to the data buffer 80. Microprocessor 66, which is connected via LBUS to the data buffer 80, senses this condition as the absence of actuation of any of the keypad scanner control switches. However, when a selected one of the switches, such as switch 90, is actuated to the closed position, this pulls down the voltage level on the switch side of a corresponding resistor, in this case resistor 84*a*, resulting in a lower input on one of the line inputs to data buffer 80. Microprocessor 66 detects this condition as indicating an actuation of the selected switch, in this case switch 90, on the control panel of keypad scanner 72. Thus, control information, provided by operator actuation of the keypad scanner 72, is provided to the microprocessor 66**.

Figure 5:
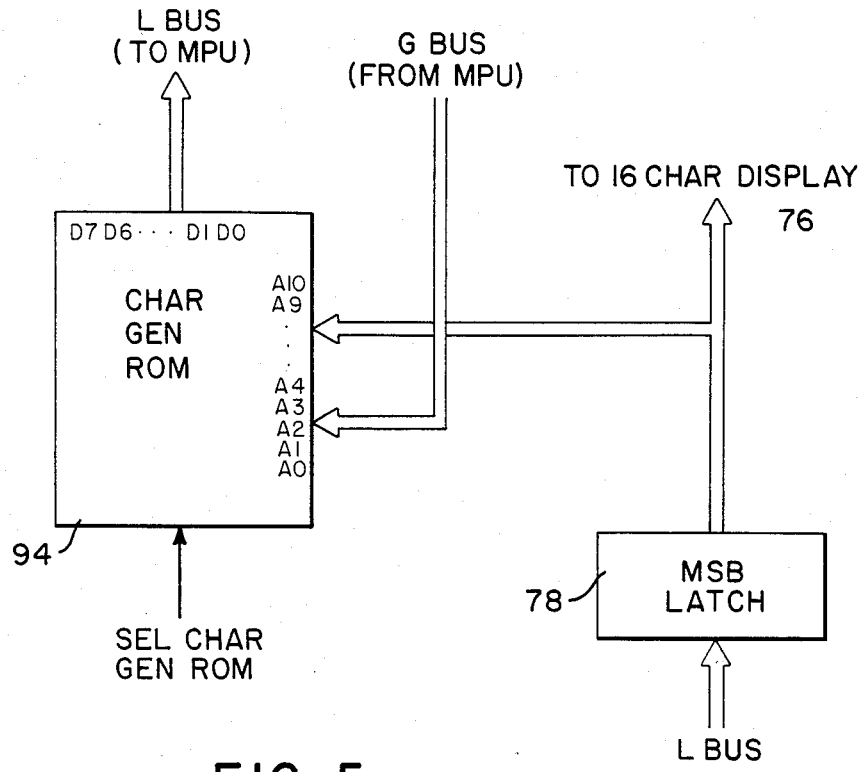
FIG. 5 is a block diagram of the character generator ROM and associated latch circuits.

FIG. 5 is a block diagram showing a further element, character generator ROM 94, of the system 60 of FIG. 3. Character generator ROM 94 is a read-only memory which stores display data messages, and is addressed via its eleven address inputs A0–A10. In accordance with the present invention, a special addressing scheme is implemented with respect to the character generator ROM 94. Specifically, the ROM 94 stores phrases consisting of individual characters (such as "OFFENSE STRATEGY?"). In order to efficiently and quickly read a given phrase from ROM 94, the unique addressing scheme of the present invention calls for the upper seven bits A4–A10 of the address to be provided by microprocessor 66, via LBUS, to the MSB latch 78, wherein it is held and applied to the terminals A4–A10 of ROM 94. In the meantime, the lower four bits of the address are provided by microprocessor 66 via GBUS to the terminals A0–A3 of ROM 94. Thus, whereas the upper bits of the address are held constant in latch 78, the lower bits are changed rapidly by the microprocessor 66, thus facilitating rapid access of successive locations in ROM 94 so as to sequentially read out the characters (O-F-F-E-N-S-E sp S-T-R-A-T-E-G-Y-?) of the desired phrase, the data being provided as an output on LBUS via terminals D0–D7. The character data is provided by character generator ROM 94 via LBUS to microprocessor 66, and is then, as previously discussed, provided by the microprocessor 66 via LBUS, MSB latch 78 and LSB latch 80 to the sixteen-character, fourteen-segment display (A) 76. Alternatively, character data can be provided by the microprocessor 66, via the LSB latch 80, to the sixteen-character, fourteen-segment display (B) 82.

Figure 6:
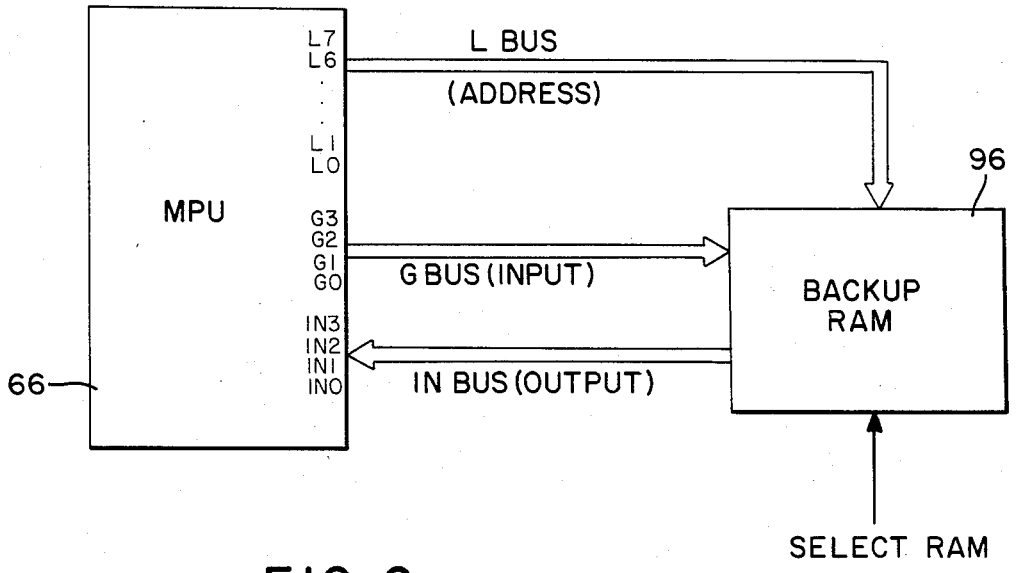
FIG. 6 is a block diagram of the microprocessor unit and back-up random access memory (RAM).

FIG. 6 is a block diagram showing a further element, backup random access memory (RAM) 96, of the system 60. This RAM 96 is active when power is on, and is in the "read" mode so long as SELECT RAM (from the function selector 86 ) is high. Address information for the backup RAM 96 is provided by microprocessor 66 via LBUS. Input data to be stored in the RAM 96 is provided via GBUS from the microprocessor 66, while output data from RAM 96 is provided to the microprocessor 66 via INBUS. In this arrangement, the backup RAM 96 provides certain advantages to the system 60 of the present invention.

The first advantage of backup RAM 96 resides in the fact that the system 60 is provided with an "instant check" capability. For example, in a write-to-memory operation, data can be held in a register within the microprocessor unit 66, while it is being written to the RAM 96 via GBUS. Once stored in RAM 96, the data can be immediately read via INBUS, so that the microprocessor unit 66 can immediately compare the data written to RAM 96 with the other (theoretically identical) data stored in the register in microprocessor unit 66.

The RAM 96 also provides the system 60 with the capability of saving key information (the type of analysis mode selected, skill level selected, the various play strategy inputs and corresponding outcomes, etc.) if the user(s) decide to take a break, with the intention of reinitiating the device at a later time. This is accomplished by operator actuation of a TIMEOUT switch **14*c* (FIG. 1), whereby power is removed from each of the elements of the system 60, except for the RAM 96, which retains the aforementioned information. Then, when play is resumed, this information will be available for use by the system 60. Moreover, the microprocessor 66 can be programmed to retrieve the last play information (or all of the information in sequence, for that matter) from the RAM 96**.

Referring back to FIGS. 3–6, the sequence of operations implemented by the system 60 of FIG. 3 is as follows. With the initiation of "power on" via OFF/ON switch **14*a* (FIG. 1), power on/reset circuit 68 provides a low reset signal to the microprocessor 66, and this serves to initialize the various elements of the system 60. Oscillator circuit 70 provides a system clock input to the microprocessor 66, thus synchronizing the operation of the microprocessor 66, as well as the operations of the various elements controlled by the microprocessor 66. The microprocessor 66, once initialized, provides an initial program address to the ROM 62 via terminals IP0–IP7 and P8–P10, as well as latch 64. As synchronized by the control output AD/DATANOT of microprocessor 66, an instruction is provided to the microprocessor 66 via terminals IP0–IP7, and the microprocessor 66** implements that instruction.

Typically, such instruction can call for the generation of a control signal by the function selector 86, and the microprocessor 66 causes this to occur by providing an appropriate four-bit control output to the function selector 86 via DBUS. For example, if a reading of the keypad scanner 72 is to take place, control output READ KEYBD is sent to keypad scanner 72, which also receives selection inputs from the microprocessor 66 via GBUS (as previously discussed above). Of course, function selector 86 provides the other control outputs to the various elements of the system 60, as described above.

For example, for the display of data on one of the displays 76 or 82, function selector 86 provides control output LOAD LATCH (LSB) to the LSB latch 80, which then latches data from the LBUS (provided by the microprocessor 66, such data having been obtained from the character generator ROM 94), and the LBUS latch 80 provides this data to the sixteen-character, fourteen-segment display (B) 82 (if display of a score is being implemented) or to the lowermost positions of the sixteen-character, fourteen-segment display (A) 76 (if an alphanumeric "feedback" message is being displayed to the user).

Of course, display of data (for example, display of score data) is further carried out as a result of enablement of the character select circuit 84 (via CHAR DISPB), as well as provision of a selection input, via GBUS, to the character select circuit 84, which issues an appropriate character select output to the display 82, thus indicating the particular character position to be displayed on display 82. A similar procedure, of course, takes place with respect to the sixteen-character, fourteen-segment display (A) 76, as controlled by the character decoder 74, as previously described.

A unique feature of the present invention resides in the fact that the keypad 15 of the device 10 of FIG. 1 is interchangeable, so that the user has the capability of selecting a particular sport to be implemented by the device 10, removing the current keypad 15 and substituting another keypad 15 corresponding to the particular sport to be played, thus converting the device 10 from one sport (for example, baseball) to another (for example, football). In order to provide this capability, the present invention calls for certain elements of the system 60 of FIG. 3 to by physically associated with the keypad 15 of FIG. 1. In the preferred embodiment, the ROM 62, its associated latch 64, the keypad scanner 72, the power on/reset circuit 68, the oscillator circuit 70, and the character generator ROM 94 are all physically associated with the keypad 15 of the device 10. The physical association of these elements with the keypad 15 is accomplished utilizing integrated circuit techniques well-known to those of skill in the art.

As a result of this unique feature of the present invention, the device 10 is, as previously mentioned, readily adaptable so that the operator can quickly convert the device from one sport to another. By virtue of the physical association between the aforementioned elements and the keypad 15, the control inputs (corresponding to the controls associated with the keypad scanner 72), the alphanumeric display messages (as contained in the character generator ROM 94), and the various programming operations to be carried out by the microprocessor 66 (such programming operations being contained, in instruction format, in the ROM 62) are quickly changed so as to convert the device 10 from one sport to another.

Figure 7:
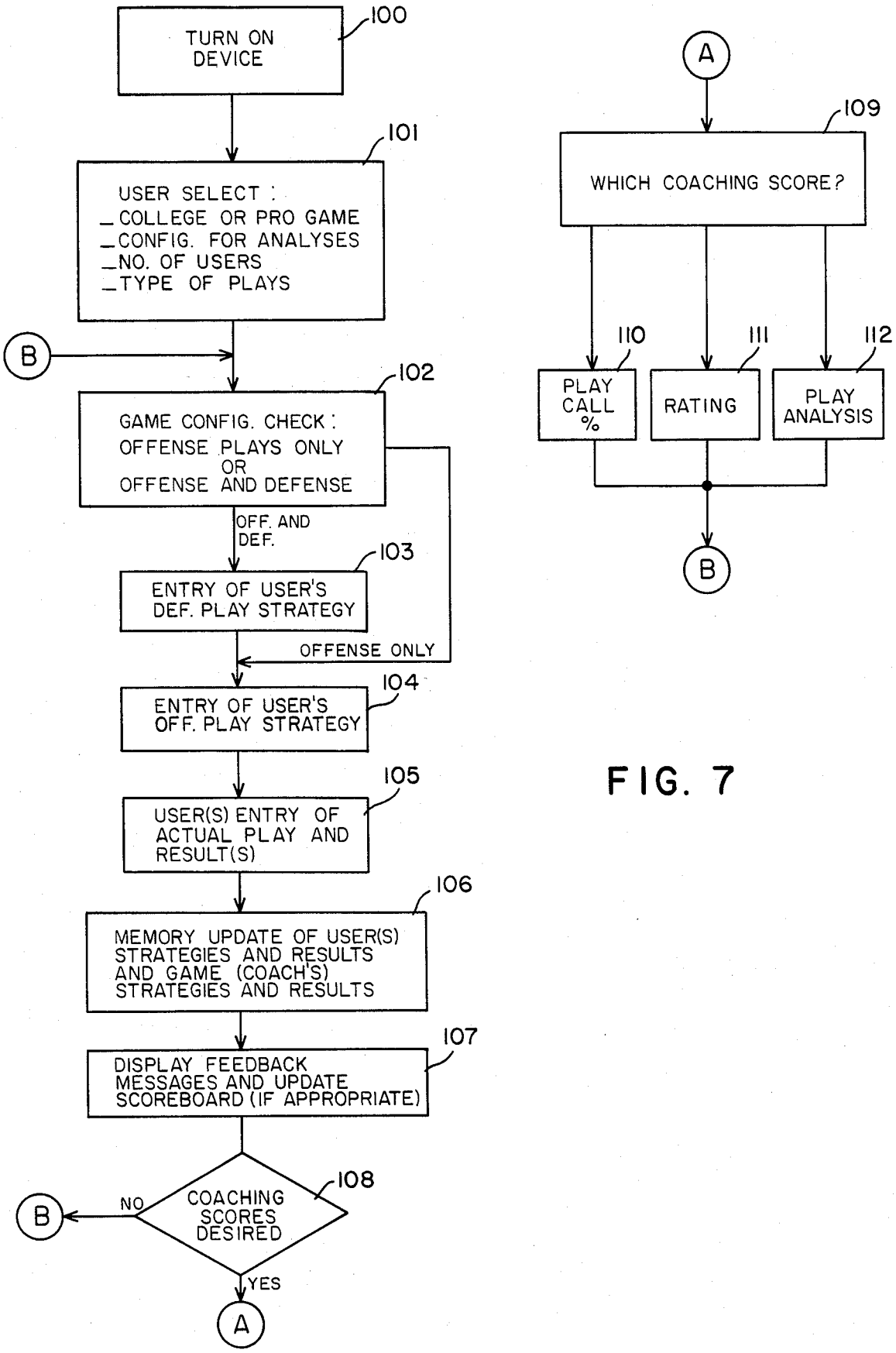
FIG. 7 is a flow chart of operations carried out by the microprocessor unit of the device.

FIG. 7 is a flow chart of operations implemented by the system 60, as controlled by the microprocessor 66, of the present invention. It should be noted that the flow chart of FIG. 7, presented for the application of the device to football, has been kept relatively simple in order to describe the basic operations carried out by microprocessor 66. It is possible, of course, for the device to be applied to other sports, an array of play strategies, outcomes and function keys, appropriate to the sport being implemented by the device, being contained on the interchangeable sports keypad 15 (FIGS. 1 and 2) with the various ROM's 62 and 94 and other elements being included therein, as described previously.

Referring to FIG. 7, based on user selections at block 101, game configuration checks are done at block 102 (e.g., "offense plays only" or both "offense and defense play strategies" to be entered by the user). The microprocessor 66 then transfers to blocks 103 and 104, per the particular game configuration. At blocks 103 and/or 104, the user(s) enters his (their) play strategy (strategies) via function keys 16, 18, 20–27, or 48–56 (for kicking game strategies).

After occurrence of the actual play by the team on the field, the user(s) enters the actual results of the player, that is, the actual team's play strategy, play event, and yardage (i.e. quantitative empirical) result (if appropriate) via the relevant device function keys 16, 18, 20–27 and 48–56 (for play strategy); function keys 28–30, and 32–34 (for selected play events); and function keys 42, 46, plus numerically referenced keys 16, 18, 20–27 (for entering actual numerical yardage results in the form of positive or negative numbers, if appropriate). Execution of blocks 103–105 (FIG. 7) is accomplished by alpha phrase promptings/questions to the user(s) with phrase "echos" as per the actuated keys.

At block 106, computer memory updates to user play strategies, events and results are accomplished, along with memory updates to the team coach's (game) equivalent data arrays. After displaying alpha phrase feedback messages to the users, and updating the scoreboard as appropriate at block 107 (utilizing displays 12 and 13 as per FIG. 1), the systems program returns to block 102 for game configuration checks. The device is, at that juncture, ready to repeat blocks 102–107 in terms of operational flow.

Any time the device is on, at user-selected instances, a variety of "coaching analyses" scores utilizing alphanumeric presentations are possible. If these are desired, microprocessor 66 will transfer to block 109 and perform one of three generic types of coaching analyses, dependent on which of function keys 36, 38 or 40 has been actuated by the user(s), and then returns to block 102 upon completion. Display presentations are provided on device displays 12 and 13, in accordance with desired data and analyses as determined by the user via selected function keys.

While preferred forms and arrangements have been shown in illustrating the invention, it is to be clearly understood that various changes in detail and arrangement may be made without departing from the spirit and scope of this disclosure.

What is claimed is:

1. A sports analysis device for use by at least one user in conjunction with observation of an actual sporting event involving actual plays and actual teams, wherein said analysis device is utilized simultaneously with the course of the actual sporting event to analyze the effectiveness of said at least one user in choosing play strategy when compared with the team's actual plays and actual results, said device comprising:

selection means actuable by said at least one user to select a play strategy choice deemed by said at least one user to be a play strategy appropriate for implementation in the actual sporting event;

memory means for memorizing each said play strategy choice selected by said at least one user;

entry means for entering into said device the actual team's actual play strategy and the quantitative empirical results of the actual play that took place in the actual sporting event wherein the quantitative empirical results can be positive or negative numbers;

processing means for processing said play strategy choice, actual play strategy, and quantitative empirical results entered into said device by said at least one user, said processing means serving to analyze the same and to evaluate the effectiveness of said play strategy choice selected by each said at least one user by comparing the same with the actual team's actual play strategy and based upon the quantitative empirical results of the said actual play; and display means for displaying feedback messages apprising each said at least one user of the analysis and evaluation of said effectiveness of said play strategy choice.

2. The device of claim 1, said device further including selecting means for selecting a given degree of performance with respect to which the effectiveness of each said at least one user is evaluated.

3. The device of claim 1, said device having a plurality of configurations, and further including selecting means for selecting one of said plurality of configurations.

4. The device of claim 3, wherein said device is usable while observing a football game, said plurality of configurations comprising an offense-only mode and an offense-defense mode, said selection means being actuable for selecting an offensive strategy in said offense-only mode, and for selecting offensive and defensive strategies in said offense-defense mode.

5. The device of claim 1, said device further including selecting means for selecting a given number of users to use said device.

6. The device of claim 5, wherein said number of users is two users, and said selection means is used, in sequence, by said two users to select respective play strategies.

7. The device of claim 6, wherein said processing means includes means for analyzing and evaluating the respective play strategies of said two users and said display means includes means for displaying a relative measure of the respective performances of said two users.

8. The device of claim 7, wherein said displayed relative measure of the respective performances of said two users includes an analysis of the effectiveness of plays.

9. The device of claim 1, said device further including selecting means for selecting a desired array of available strategies from which to choose when selecting, via said selection means, said respective play strategy deemed by said at least one user to be a play strategy appropriate for implementation in the actual sporting events.

10. The device of claim 1, wherein said selection means comprises an interchangeable keypad scanner.

11. The device of claim 1, wherein said memory means comprises a random access memory.

12. The device of claim 1, wherein said entry means comprises an interchangeable keypad scanner.

13. The device of claim 1, wherein said processor means comprises a read-only memory storing a control program, and a microprocessor connected to said read-only memory for receiving and executing said control program.

14. The device of claim 13, wherein said microprocessor, as a result of execution of said control program, produces control commands, said processing means further comprising a function selector responsive to said control commands for issuing selection commands.

15. The device of claim 14, wherein said display means is a plurality of display units, said selection commands including respective commands selecting respective display units for display of said feedback messages.

16. The device of claim 14, wherein said display means includes at least one display unit and a character generator read-only memory, said selection commands including a command for selecting said character generator read-only memory for providing characters to said at least one display unit for display.

17. The device of claim 14, wherein said selection means comprises a keypad scanner and said memory means comprises a random access memory, said selection commands including a read command for reading data from said keypad scanner, and a select-random access memory to receive and store said data read from said keypad scanner.

18. A sports analysis device for use by at least one user in conjunction with observation of an actual sporting event, involving actual plays and actual teams, wherein said analysis device is utilized simultaneously with the course of the actual sporting event to analyze the effectiveness of said at least one user in choosing play strategy when compared with the team's actual plays and actual results, said actual sporting event being of a type selected from a plurality of types of events, said device comprising:

selection means actuable by said at least one user to select a play strategy choice deemed by said at least one user to be a play strategy appropriate for implementation in the actual sporting event;

memory means for memorizing each said play strategy choice selected by said at least one user;

entry means for entering into said device the actual team's actual play strategy and the quantitative empirical results of the actual play that took place in the actual sporting event, wherein the quantitative empirical results can be positive or negative numbers;

processing means for processing said play strategy choice, actual play strategy, and quantitative empirical results entered into said device by said at least one user, said processing means serving to analyze the same and to evaluate the effectiveness of said play strategy choice selected by each said at least one user by comparing the same with the actual team's actual play strategy and based upon the quantitative empirical results of the said actual play; and display means for displaying feedback messages apprising each said at least one user of the analysis and evaluation of said effectiveness of said selected play strategy;

wherein said selection means and said entry means are implemented by a keypad scanner removably mounted on said device, said keypad scanner being removable so as to be interchangeable with another keypad scanner, whereby to convert said device from one type of sporting event to another.

19. The device of claim 18, wherein said memory means comprises a random access memory, said processor means including a microprocessor issuing control commands and a function selector responsive thereto for issuing selection commands, said selection commands including a read command for reading data from said keypad scanner, and a select-random access memory to receive and store said data read from said keypad scanner.

* * * * *

UNITED STATES PATENT AND TRADEMARK OFFICE

CERTIFICATE OF CORRECTION

PATENT NO. : 4,496,148

DATED : January 29, 1985

INVENTOR(S) : Barry R. Morstain et al

It is certified that error appears in the above-identified patent and that said Letters Patent is hereby corrected as shown below:

The sheet of Drawing Consisting of Figure 2 should be deleted to appear as per attached sheet.

Signed and Sealed this

*Twenty-seventh* Day of *August 1985*

[SEAL]

*Attest:*

DONALD J. QUIGG

*Attesting Officer*

*Acting Commissioner of Patents and Trademarks*

UNITED STATES PATENT AND TRADEMARK OFFICE

CERTIFICATE OF CORRECTION

PATENT NO. : 4,496,148

DATED : January 29, 1985

INVENTOR(S) : Barry R. MORSTAIN et al

It is certified that error appears in the above-identified patent and that said Letters Patent are hereby corrected as shown below: Please substitute Figure 2 below, for Figure 2 of the issued patent.

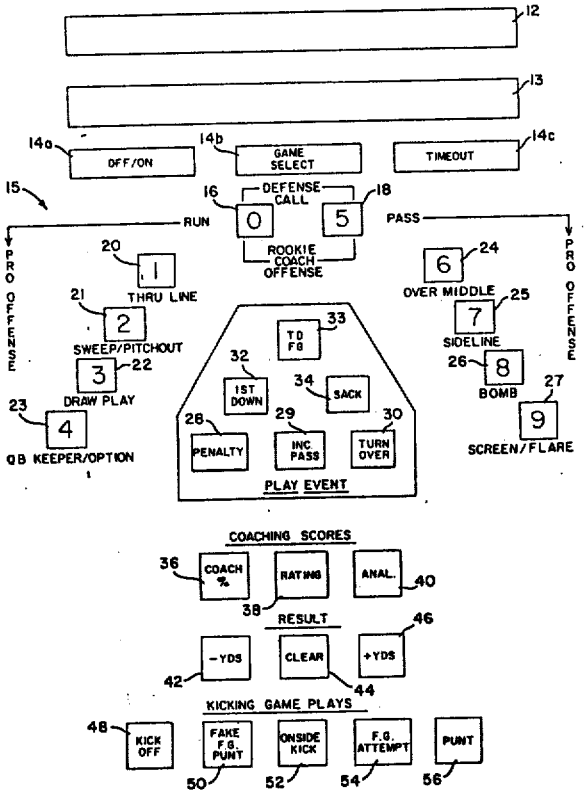

FIG. 2